United States Patent [19]

Albertson et al.

[11] Patent Number: 4,981,396

[45] Date of Patent: Jan. 1, 1991

[54] MULTIPLE PIPE INSTALLATION BACKFILLING, AND COMPACTION ATTACHMENT

[75] Inventors: Philip E. Albertson; Arthur D. Deken; Freddie Nichols, all of Perry, Okla.

[73] Assignee: The Charles Machine Works, Inc., Perry, Okla.

[21] Appl. No.: 316,708

[22] Filed: Feb. 28, 1989

[51] Int. Cl.[5] ..... E02F 5/10; F16L 3/22

[52] U.S. Cl. ..... 405/178; 405/179; 405/180; 405/271; 37/142.5; 37/87; 37/DIG. 18

[58] Field of Search ..... 405/177, 178, 179, 180, 405/182, 184, 271; 37/189, 87, 142.5, DIG. 18

[56] References Cited

U.S. PATENT DOCUMENTS

| | | | |
|---|---|---|---|
| 3,201,948 | 8/1965 | Schramm | 37/142.5 X |
| 3,471,953 | 10/1969 | Wyatt | 37/142.5 |
| 3,575,006 | 3/1971 | Rugroden et al. | 405/182 |
| 3,583,168 | 6/1971 | Harton | 37/142.5 X |
| 3,851,489 | 12/1974 | Richardson | 405/178 |
| 3,948,059 | 4/1976 | Pampa | 405/178 |
| 4,332,511 | 1/1982 | Bradley et al. | 405/178 |
| 4,650,370 | 3/1987 | Kassner et al. | 405/183 |

FOREIGN PATENT DOCUMENTS

| | | | |
|---|---|---|---|
| 410900 | 5/1934 | United Kingdom | 405/157 |

OTHER PUBLICATIONS

Publication by the Charles Machine Works, Inc. entitled "Ditch Witch 6510" dated Jul. 1986.

Publication by the Charles Machine Works, Inc. entitled "Earth-Coupled Water Source Heat Pump" dated Sep. 1987.

Publication by the Charles Machine Works, Inc. entitled "Earth-Coupled Water Source Heat Pump" dated Sep. 1987.

*Primary Examiner*—Randolph A. Reese
*Assistant Examiner*—Arlen L. Olsen
*Attorney, Agent, or Firm*—Banner, Birch, McKie & Beckett

[57] ABSTRACT

A multiple pipe chute installation for continually and progressively excavating a trench, laying flexible utility pipe a predetermined vertical distance apart, refining and refilling the soil around the laid pipes, and compacting the refilled soil is disclosed. The installation includes a trenching chain assembly pivotably mounted to the rear of a vehicle for excavating a trench. A multiple pipe chute assembly including a plurality of chutes is pivotably attached to a support frame extending from the trenching chain assembly. A support arm is pivotably attached to the support frame and extends rearwardly of the chute. A backfiller assembly is attached to the end of the support arm and a compacting rod is attached to the support arm adjacent the backfiller assembly. A hydraulic cylinder is attached between an extension of the support frame and the support arm. The chute assembly may be selectively linked to either the trenching chain assembly or the support arm. Therefore, the hydraulic cylinder may expand or contract to raise or lower either the support arm alone with respect to the chute assembly and trenching assembly, or both the support arm and the chute assembly with respect to the trenching chain assembly.

24 Claims, 7 Drawing Sheets

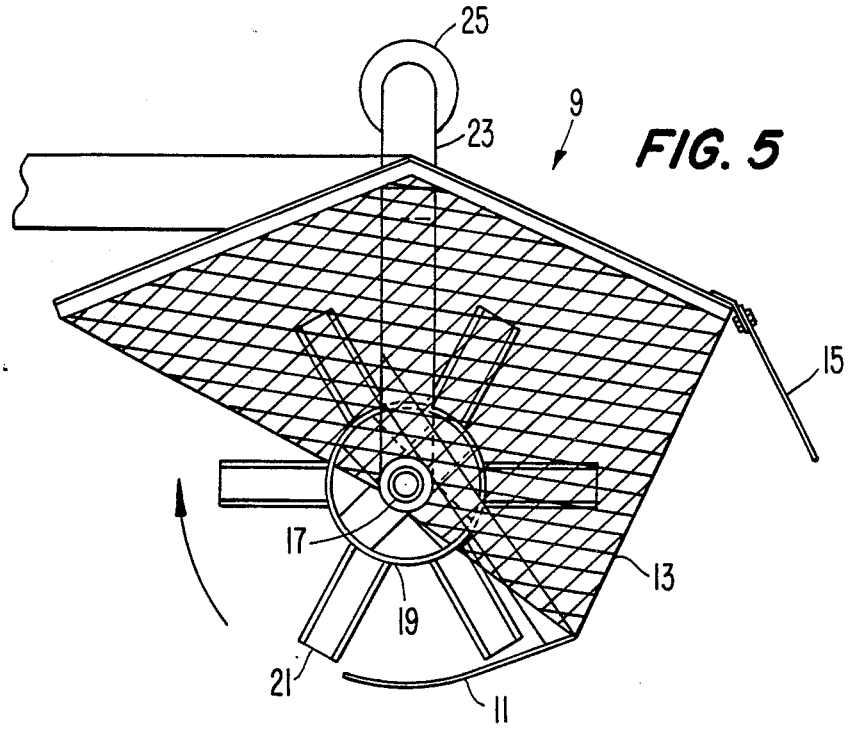
FIG. 5
FIG. 6
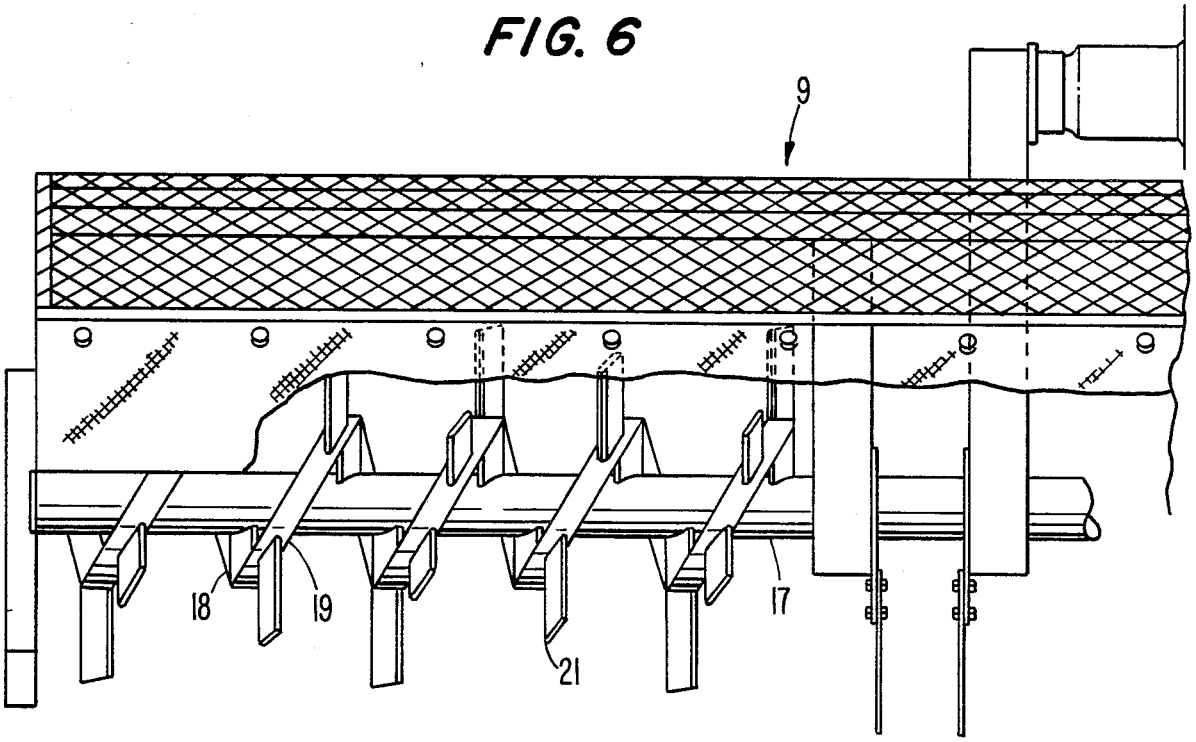

MULTIPLE PIPE INSTALLATION BACKFILLING, AND COMPACTION ATTACHMENT

BACKGROUND OF THE INVENTION

The present invention is directed to a multiple pipe installation attachment, and more particularly, to an attachment for the rear of a vehicle which allows for progressive and continuous excavation of a trench in the earth, laying of a plurality of flexible utility pipes in the excavated trench, refilling of the trench over the pipes with the excavated soil and compaction of the refilled soil.

DESCRIPTION OF THE PRIOR ART

Apparatuses for laying utility lines or cables underground are known in the art. U.S. Pat. No. 3,851,489 to Richardson discloses a line laying apparatus including a plurality of guide chute passages through which a plurality of separate cables are laid in the ground. Each of the separate types of cables is wound around a separate reel which are located on a wheeled cart. Each reel may be the source of more than one line of cable. The guide chute is located to the rear of a cutting blade which is disposed on the rear of a vehicle. The wheeled cart and the reels are located forward of the vehicle. Forward motion of the vehicle and action of the cutting blade cause a small trench to be cut into the earth, and the cables are unwound from the reels and laid in the trench. The trench is small and apparently "self-closing." However, since the size of the trench appears to be limited, the depth to which cables may be laid is limited. Additionally, Richardson provides no refill and compaction means for the excavated soil as they are not necessary due to the limited size of the excavation.

U.S. Pat. No. 4,650,370 to Kassner et al. is directed to a high-speed cable-laying apparatus which includes a forwardly located chain line trencher, a cable chute disposed on the rear of the trencher, a wheeled trailing structure for carrying a single reel of cable, and plow blades beneath the trailing structure. The apparatus is attached to the rear of a tractor, and forward progress and operation of the trencher cause a trench to be excavated, cable to be laid, and the trench refilled by the plow blades. However, Kassner et al. provides for only a single reel of cable and only one cable chute, and can therefore lay only one line at a time. Additionally, there is no provision of a compacting ram for compacting the dirt refilled in the trench, nor is there a provision for the capability for making a water slurry of the excavated soil to facilitate compaction of the soil.

SUMMARY OF THE INVENTION

It is an object of the present invention to provide a multiple pipe installation attachment for the rear of a tractor which simultaneously performs the functions of excavating a trench, laying a plurality of vertically spaced flexible pipes, refining and refilling the soil over the trench, and compacting the refilled soil.

It is another object of the present invention to provide a multiple pipe installation having means for creating a water slurry of the refined and refilled soil to facilitate compacting and to eliminate air pockets which decrease the heat transfer along the laid pipes.

It is another object of the present invention to provide a multiple pipe installation having a compacting ram with an adjustable compacting angle relative to the surface of the refilled soil.

It is another object of the present invention to provide a multiple pipe installation having a multiple pipe chute and a support arm which supports both the backfiller assembly and the compacting ram assembly such that the chute and the arm may be linked so as to be vertically liftable jointly with respect to the trenching assembly, or such that the support arm is not linked to the chute and instead the chute is linked to the trenching assembly and the support arm is vertically liftable with respect to both the chute and the trenching assembly.

It is another object of the present invention to provide a multiple pipe installation having a multiple pipe chute including a pipe retainer bar at one end thereof for retaining the pipes in the chute during pipe-laying operation, and a tension brake assembly including individually adjustable screws for adjusting the tension on each separate flexible pipe to prevent sagging.

It is another object of the present invention to provide a multiple installation having a belting located rearward of and above the multiple pipe chute to prevent refilled soil or slurry from entering the area between the trenching assembly and the multiple pipe chute and thereby decreasing the trenching efficiency of the trencher.

It is another object of the present invention to provide a variable frequency concrete vibrator head centrally located with respect to the plurality of laid pipes for increasing the effectiveness of the compaction of the refilled soil or slurry.

These and other objects are obtained by the present invention which includes a multiple pipe installation attachment which is pivotally mounted to a rearward flange of a tractor. The multiple pipe installation essentially consists of several attached and interacting structures for: excavating a trench, laying a plurality of flexible pipes or cables in a vertically spaced manner in the trench, refilling the trench and compacting the refilled soil. A forward trenching assembly is pivotably mounted on the rear of a vehicle such as a tractor. The trenching assembly includes a rotating trenching chain having trenching teeth extending therefrom. Although a chain is the preferred form of the invention, other drive mechanisms, such as a belt, could be used. Rotation of the trenching chain causes the trenching teeth to dig into the earth and move soil upwardly thereby progressively digging a trench into the ground upon forward movement of the vehicle. The excavated soil is moved sidewardly of the trenching assembly on the surface by laterally disposed trenching augers.

A multiple pipe chute is pivotably attached to an H-shaped frame extending from the rear of the trenching assembly and includes a plurality of chutes through which a plurality of flexible cables or pipes may extend. At the initiation of the pipe-laying operation after the initial trench has been excavated, the ends of the flexible pipes are extended through the pipe chutes and are attached to a vertically disposed pole anchor. Forward progress of the towing tractor causes the flexible pipes to be withdrawn from the pipe chute as it progresses forwardly in the trench.

A pivotable support arm is pivotably attached to the H-shaped frame. At the opposite end of the arm, a backfiller assembly is disposed and includes a rotating drive shaft having a helical-shaped cutting bar extending therearound. Cutting blades extend from the cutting bar and the shaft is rotated by a drive motor. Rotation of the cutting blades causes the soil which has been excavated to be cut and refined into smaller clumps and to be propelled forward and refilled over the laid pipes. A water valve is disposed on the support arm immediately forward of the backfiller assembly and if water is available it is used to convert the excavated soil to a slurry to facilitate compaction. An extendible compacting rod is disposed at an intermediate position along the backfiller arm such that when the rod is extended, it terminates below and slightly behind the backfiller shaft. Forwardly propelled soil (or slurry if a source of water is available) is compacted by the compacting rod. The angular position of the compacting rod is adjustable.

The support arm and its supported assemblies and the pipe chute may be linked by a pin extending through pinholes of appropriate extensions and thus the support arm and pipe chute may be raised or lowered jointly with respect to the trenching assembly. Alternatively, the pin may be removed and a hook extending from the H-shaped support frame may be disposed around a pipe chute extension shaft, thus linking the trenching assembly and the pipe chute and releasing the link between the pipe chute and the support arm. Thus, the support arm is raised or lowered independently of the pipe chute. The raising or lowering is accomplished by a hydraulic cylinder disposed between an extension of the H-shaped frame and the joint of the support arm with a pivotable support pivotably attached to the H-shaped frame. The support arm may also pivot in a plane perpendicular to the longitudinal axis of the pivotable support.

Further objects, features and other aspects of the invention will be understood from the detailed description of the preferred embodiments of this invention with reference to the annexed drawings.

BRIEF DESCRIPTION OF THE DRAWINGS

FIG. 5 is a side view of the backfiller assembly.

FIG. 6 is an end view of the backfiller assembly.

DETAILED DESCRIPTION OF THE PREFERRED EMBODIMENTS

Figure 1:
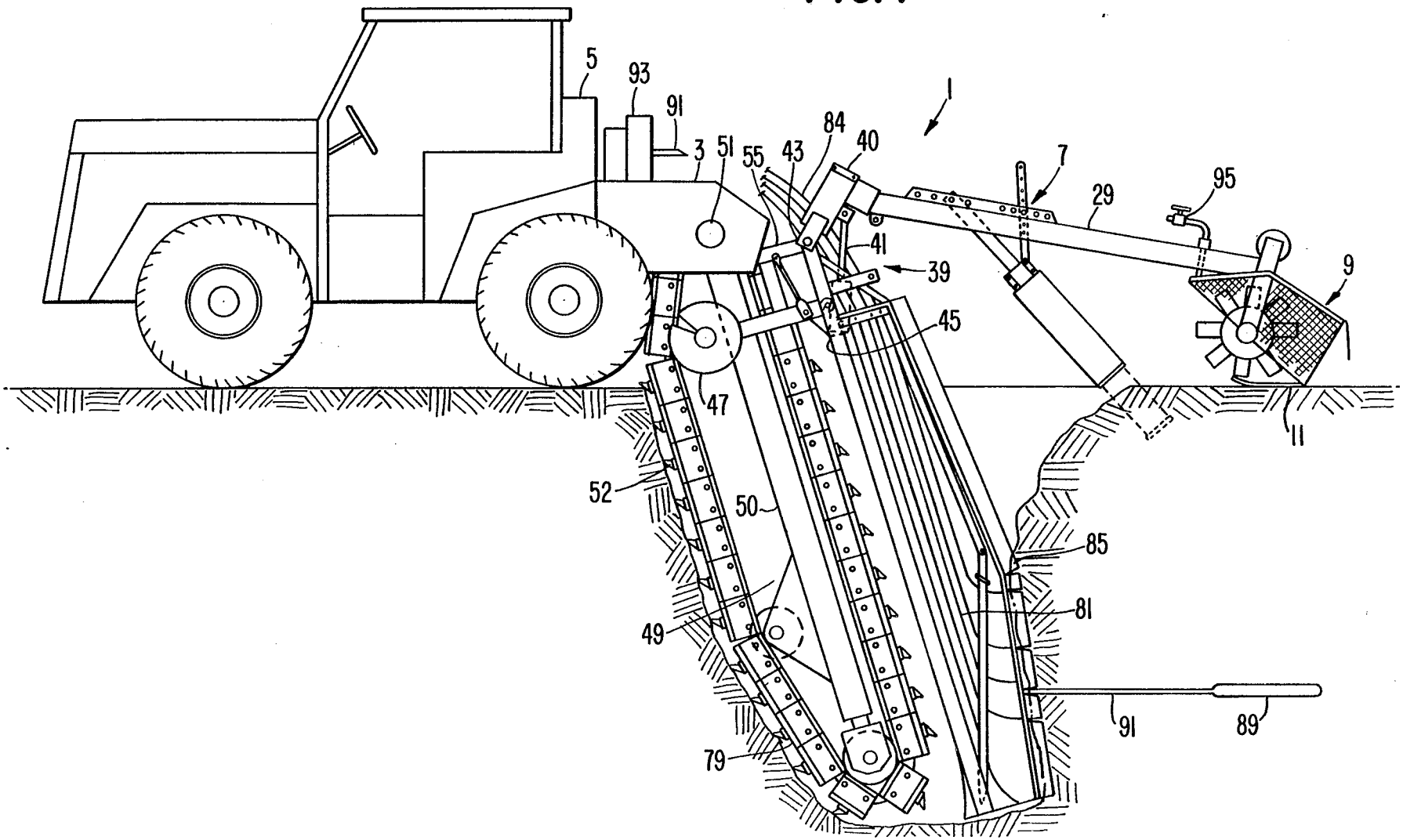
FIG. 1 is an overall side view showing the multiple pipe installation attached to the rear of a tractor.
Figure 2:
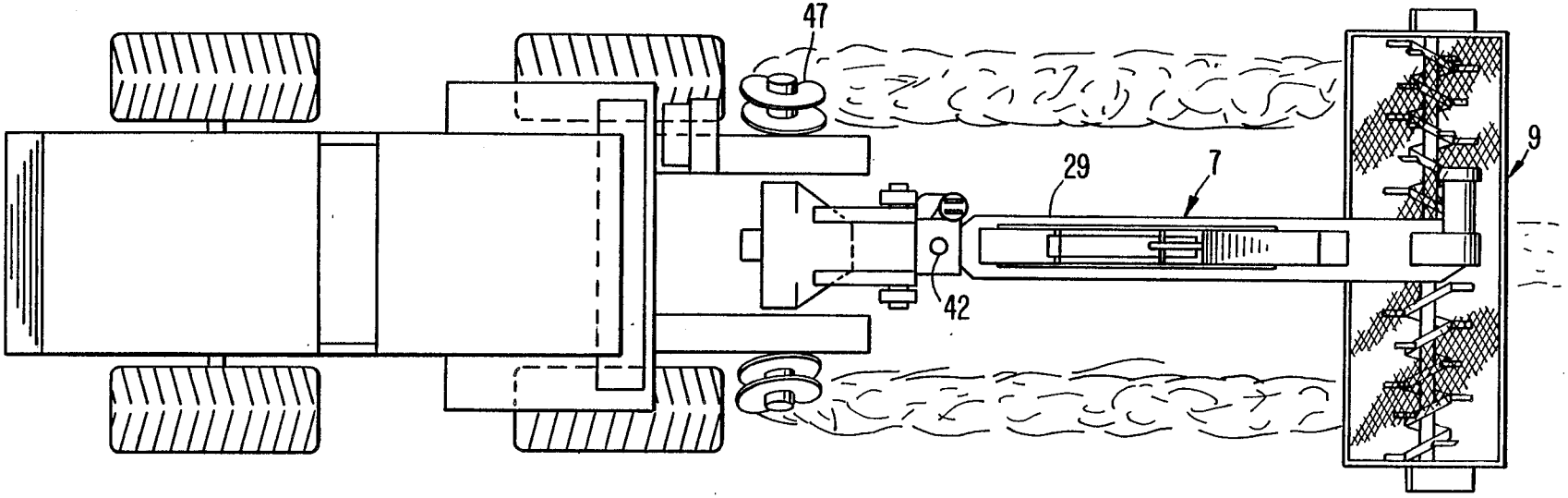
FIG. 2 is an overhead view of the apparatus shown in FIG. 1.

As shown in FIG. 1, automatic multiple pipe installation, backfilling and compaction attachment 1 includes trenching assembly 49 pivotably attached at pivot 51 to tractor extension 3 fixedly disposed at the rear of tractor 5. H-shaped support frame 55 is fixedly attached to trenching assembly 49. H-shaped support frame 55 includes dual H-frames, one on either side of trenching assembly 49. Multiple pipe chute assembly 81 and support 40 are pivotable about pivot shaft 43 at one corner of the H. Raising and lowering assembly 39 includes H-shaped frame 55, support 40, and hydraulic positioning cylinder 41 extending between extension 45 of H-shaped frame 55 and hydraulic cylinder rod end pin 53 on support 40. Support arm 29 extends from one end of support 40 of raising and lowering assembly 39. Support arm 29 may pivot about pivoting rod 42 extending longitudinally through support 40. Support arm 29 includes a narrowed extending end portion (not shown) fitting into support 40 to allow support arm 29 to pivot about pivot rod 42. Backfiller auger assembly 9 is located at the opposite end of arm 29 from the narrowed end portion. Compacting ram assembly 7 is supported on arm 29 and extends generally downward therefrom, and is positioned intermediate of support 40 and backfiller auger assembly 9. With reference to FIG. 2, trenching augers 47 extend laterally of trenching assembly 49.

Figure 3:
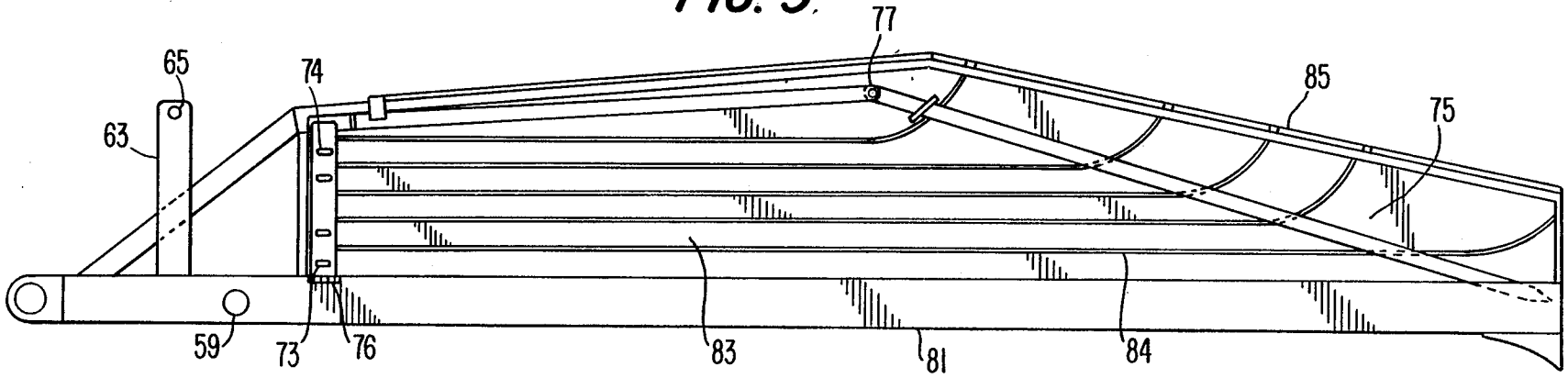
FIG. 3 is a side view of the multiple pipe chute assembly including belting located to the rear of the open-faced chutes.

With reference to FIG. 3, multiple pipe chute assembly 81 is shown. Pipe chute assembly 81 includes a plurality of linear and parallel pipe chutes 83 generally curving into perpendicular pipe exiting ends. One flexible pipe 84 is disposed in each chute 83. A plurality of flexible pipes may be laid a predetermined distance apart from each other in the vertical direction depending on the distance between the terminal ends of the chutes. Pipe chute assembly 81 is generally open on its side surface, that is, the side being viewed in FIGS. 1 and 3.

Pipe chute assembly 81 further includes pipe retainer bar 75 extending downwardly across the lower side surface of pipe chute assembly 81 near the terminal ends of pipe chutes 83. Pipe retaining bar 75 includes hinged lever 77 allowing it to be removed by a straight pull if desired. Tension brake assembly 73 is located across the upper terminal ends of pipe chutes 83. Tension brake assembly 73 includes individually adjustable screws 74 for individually adjusting the tension on each flexible pipe 84. Tension brake assembly 73 is hinged at 76 and is removable. Pipe retainer bar 75 retains flexible pipes 84 within chutes 83 during trenching and laying of pipes. Tension brake assembly 73 prevents sagging of the pipes.

Belting 85 is located generally to the rear of pipe chute assembly 81 and has a generally gully or C-shaped cross section. Belting 85 follows the rearward contour of pipe chute assembly 81 and includes a plurality of slits in its lower portion corresponding to the terminal ends of the pipe chutes and through which flexible piping is dispensed during the pipe-laying operation. Belting 85 extends down to below the terminal end of the lowermost pipe chute and prevents soil or slurry created by water mixed with refilled soil from seeping below the end of pipe chute assembly 81 and thereby entering the region between pipe chute assembly 81 and trenching assembly 49. The provision of belting 85 prevents refill soil or slurry from clogging trenching assembly 49 and thereby reducing the efficiency of trenching assembly 49 as well as keeping soil or slurry from pipe chute assembly 81.

Pipe chute assembly 81 further includes chute locking shaft 59 extending from and fixed to the forward surface of chute assembly 81, and locking extension or projection 63 extending rearwardly towards support arm 29 from the forward surface of chute assembly 81 adjacent shaft 59. Chute locking pinhole 65 extends through chute projection 63.

With further reference to FIG. 1, trenching assembly 49 is shown and includes digging chain 79 looped around trenching support arm 50. Trenching teeth 52 extend uniformly around digging chain 79, from its exterior surface, such that earth is dislodged and coveyed upwardly upon rotation of digging chain 79. Trenching augers 47 extend laterally along either side of digging chain 79 and are rotatably mounted on a central support axle (FIG. 2). Trenching augers 47 convey excavated soil laterally away from assembly 49.

With reference to FIGS. 4, 7, 8 and 9, multiple pipe chute assembly 81, support arm 29, and raising and lowering assembly 39 including H-shaped support frames 55 are shown. H-shaped frames 55 are fixedly attached to trenching assembly 49 at the forward ends of each "H" and extend rearwardly therefrom. Pipe chute and support arm pivot shaft 43 extends between the H-shaped frames 55 at one end of the "H", and pipe chute 81, and pivoting support 40 of raising and lowering assembly 39 are pivotable there about, either jointly or separately as discussed below. Hydraulic cylinder rod end pin 53 is disposed in a projection extending from one surface of support 40. Extension 45 projects from a lower rearward end of one of the H-shaped frames 55. Hydraulic positioning cylinder 41 is disposed between extension 45 and hydraulic cylinder rod end pin 53 such that by extension or contraction of cylinder 41, support 40 is pivoted about pivot shaft 43. Thus, extension or contraction of cylinder 41 results in raising or lowering of support arm 29 which extends from support 40. Support arm 29 is also pivotable about vertical pivot rod 42 disposed in support 40. Additionally, as will be discussed below, pipe chute assembly 81 may be linked with support arm 29 such that extension or contraction of cylinder 41 jointly raises or lowers both chute assembly 81 and support arm 29 with respect to trenching assembly 49. In the alternative, pipe chute assembly 81 may be linked to trenching assembly 49 such that extension or contraction of hydraulic cylinder 41 raises or lowers only support arm 29 with respect to both pipe chute assembly 81 and trenching assembly 49.

Figure 4:
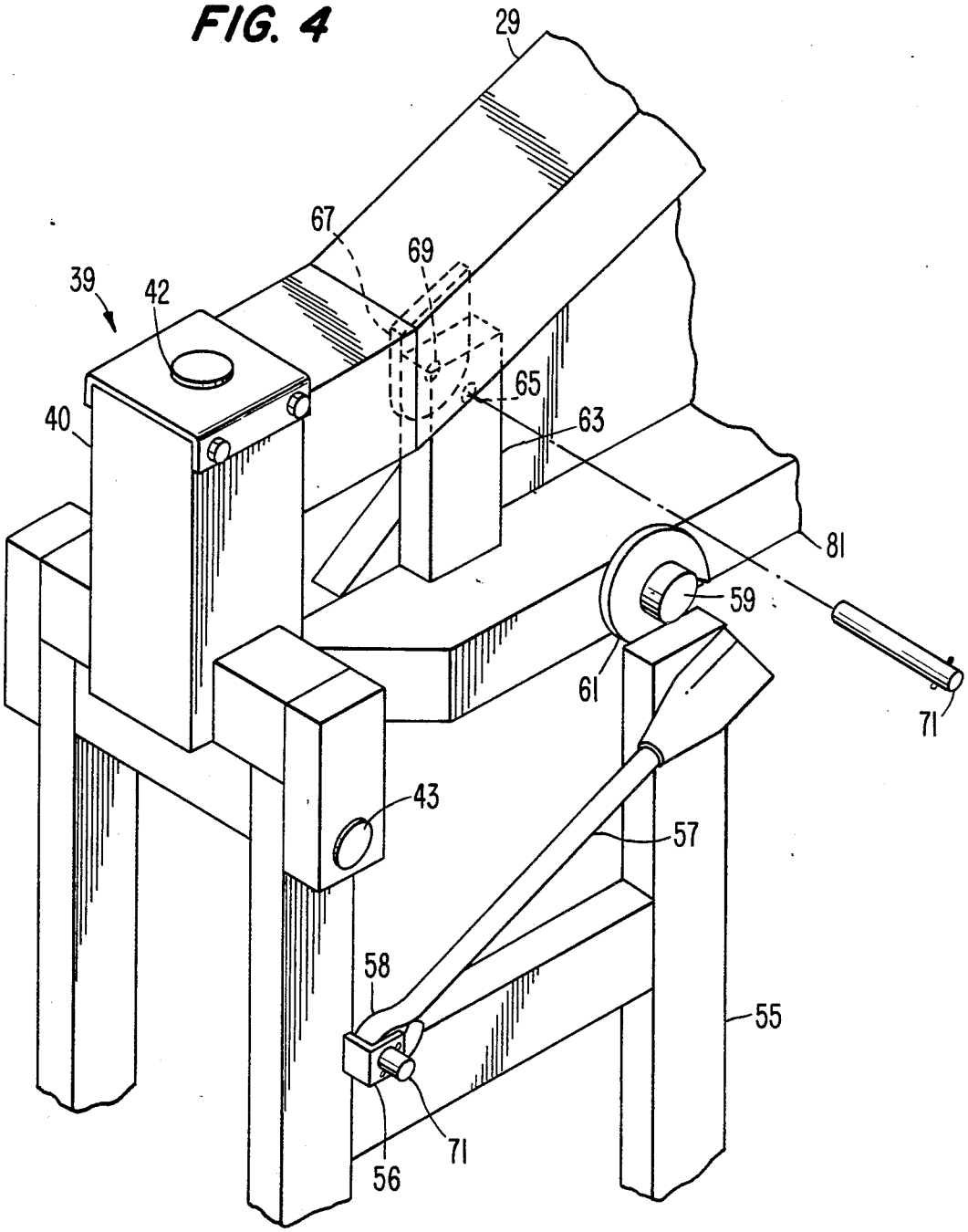
FIG. 4 is a perspective view of part of a raising and lowering assembly including an H-shaped support frame and the pivotable link between both the support arm and the multiple pipe chute and the H-shaped frame.
Figure 7:
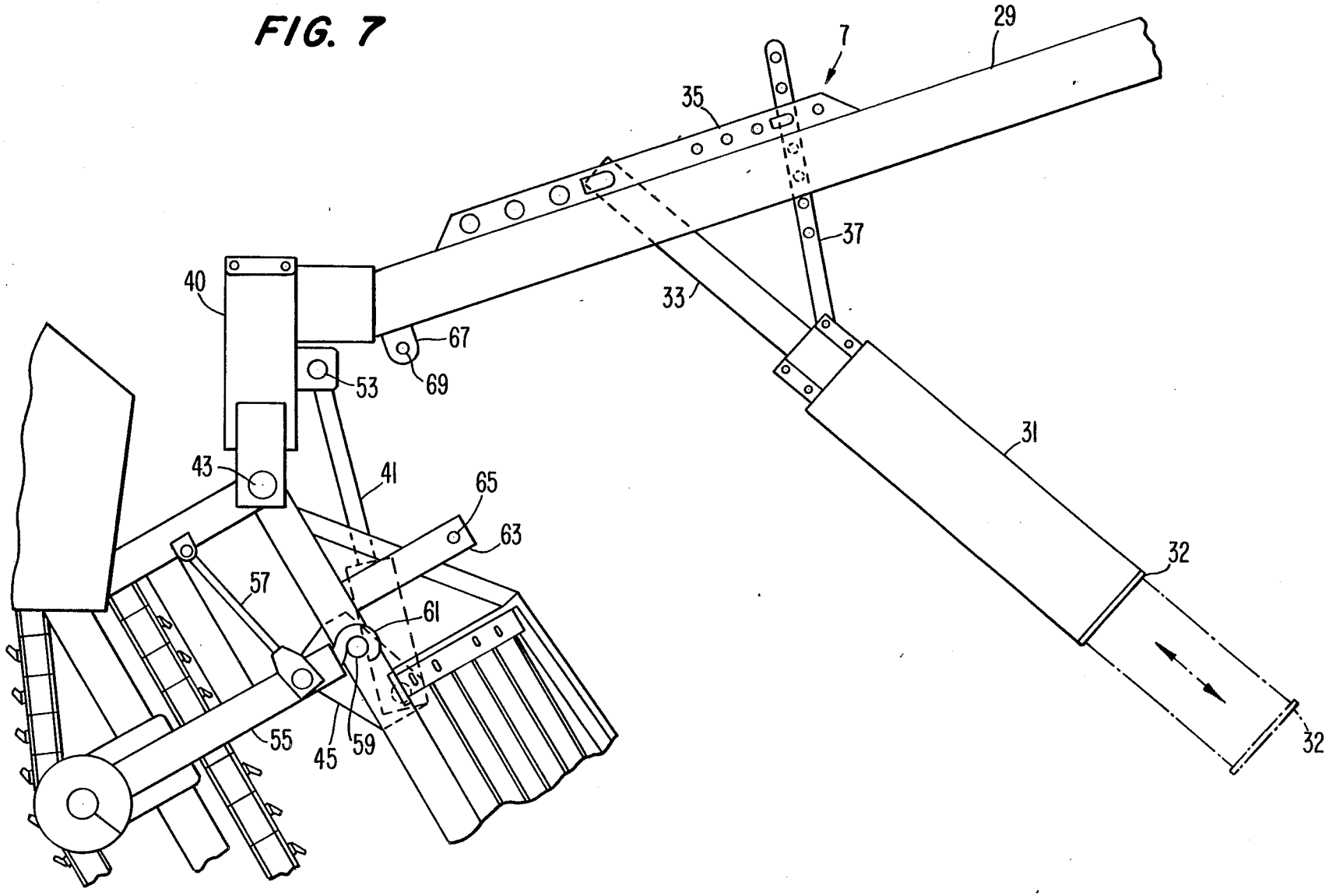
FIG. 7 is a side view including the support arm, the compacting assembly, the raising and lowering assembly including the H-shaped frame and part of the multiple pipe chute and trenching assemblies.
Figure 8:
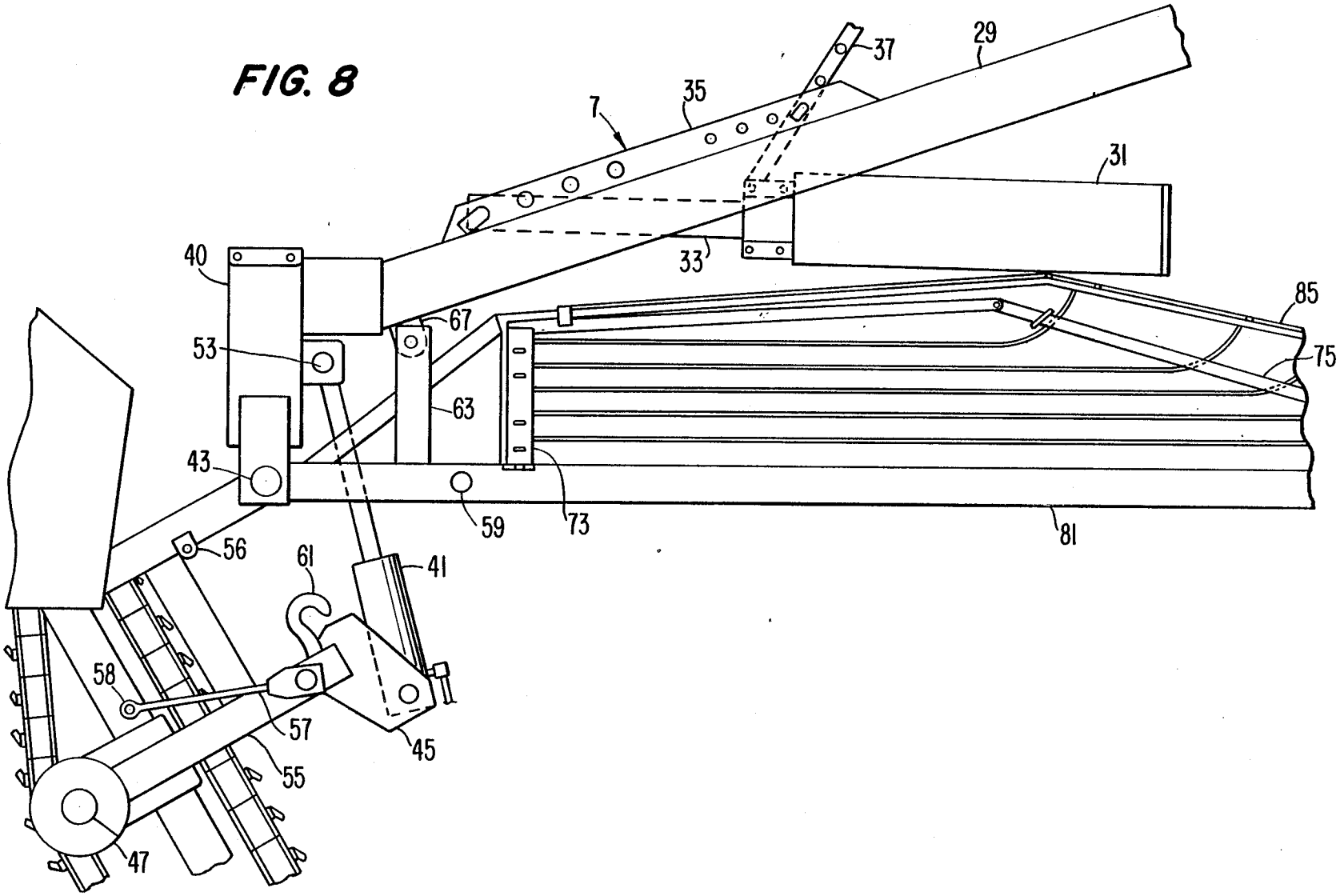
FIG. 8 is a side view showing the same features as shown in FIG. 7 in which the multiple pipe chute and the support arm are linked and raised to a horizontal position.
Figure 9:
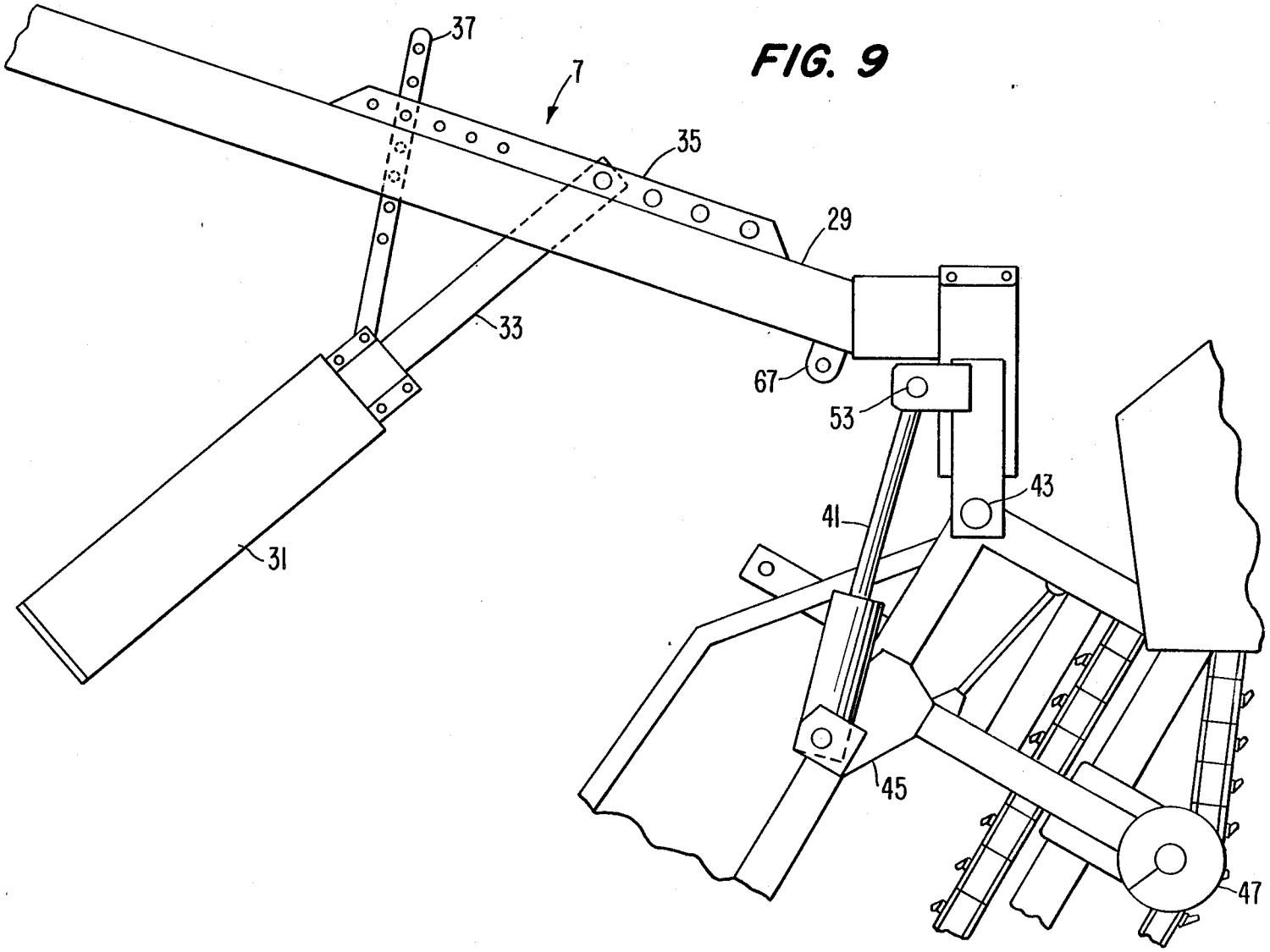
FIG. 9 is a reverse side view showing the same features as shown in FIG. 7.

With further reference to FIGS. 4, 7, 8 and 9, support arm locking extension 67 extends downwardly from support arm 29 and includes pinhole 69 extending therethrough. Support arm 29 may be moved to a position in which pinhole 69 is adjacent pinhole 65 extending through pipe chute locking extension 63 as shown in FIGS. 4 and 8. Locking pin 71 may be positioned through both pinholes 65 and 69 to lock pipe assembly 81 with support arm 29. In this configuration, extension or contraction of cylinder 41 jointly raises or lowers chute assembly 81 and support arm 29. Alternatively, as shown in FIGS. 1, 7 and 9, locking pin 71 may be removed from extensions 63 and 67 so that support arm 29 is not locked to chute assembly 81. In this position, pipe chute assembly 81 would have been previously lowered to a position adjacent to trenching assembly 49 for support.

Chute locking hook 61 is pivotably disposed near the lower rear end of the H. Locking hook 61 may be pivoted to a position around chute locking shaft 59 on chute assembly 81 to link pipe chute assembly 81 with H-shaped frame 55 and thus, with trenching assembly 49. The position of chute locking hook 61 is adjusted by hook actuating lever 57 extending between the upper and lower parts of H-shaped frame 55. The upper end of lever 57 extends into hook 58 fitting into locking block 56. As shown in FIGS. 4 and 7, locking pin 71 is inserted through hook 58 and block 56 to secure the position of hook actuating lever 57, and thus secure locking hook 61 in position around locking shaft 59 when it is desired to link trenching assembly 49 with pipe chute assembly 81. It is noted that both possible positions of locking pin 71 are shown in FIG. 4, although at any given time, locking pin 71 is either in position extending through pinholes 69 and 65 when they are adjacent with each other, or extending through hook actuating lever 57 and block 56.

With reference to FIGS. 1, 2, 5, 6 and 7, compaction ram assembly 7 and backfiller auger assembly 9 are shown. Both assemblies extend from different locations along support arm 29. With respect to compacting ram assembly 7, assembly 7 includes compacting ram mounting bracket 35 fixedly attached above support arm 29. Compacting ram support rod 33 is pivotably mounted at one end through one of a plurality of holes on one side of mounting bracket 35 and extends downwardly, supporting compacting ram hydraulic cylinder 31. Compacting ram 32 is disposed within cylinder 31 and is extendible due to operation of the cylinder as shown in FIG. 7. Compacting ram 32 is operated by a 4-way hydraulic pilot-operated valve which automatically reverses ram 32 when a predetermined pressure value is built up at the end of the cylinder stroke or when compaction forces cause the pressure to build up to the predetermined value.

Angle adjusting arm 37 extends from the end of hydraulic cylinder 31 and includes a plurality of holes therethrough which may be alternately linked with a plurality of holes extending through mounting bracket 35. These latter holes are located at an opposite side of mounting bracket 35 from the holes to which support rod 33 is attached. The hole through which rod 33 is pivotably attached and the hole through which arm 37 is attached may be individually changed as desired. Thus, the angle between the end of ram 32 and the surface to be refilled may be varied. Compaction ram assembly 7 is of course raised or lowered in unison with support arm 29.

With reference to FIGS. 5 and 6, backfiller auger assembly 9 is shown. Backfiller auger assembly 9 includes backfiller chain drive housing 23 having backfiller chain drive therein and extending downwardly from backfill auger drive motor 25 located above and at the end of support arm 29. The backfiller chain drive is linked to backfiller auger drive shaft 17 extending essentially parallel to the surface of the earth and rotating due to actuation of motor 25. Auger ribbon bar 19 is hot rolled into a helical shape and is disposed around drive shaft 17. Auger ribbon bar 19 is welded to drive shaft 17 through perpendicular bars 18. Auger cutting blades 21 are disposed at a 45° angle across the outer surface of auger ribbon bar 19. The outer diameter of helical ribbon bar 19 including blades 21 may be, for example, 20 inches, and the pitch of bar 19 may be, for example, 6 inches. Backfiller hinged mesh guard 13 surrounds the entire assembly including auger drive shaft 17, cutting bar 19 and cutting blades 21. Backfiller assembly 9 extends well beyond the lateral surfaces of support arm 29 and trenching assembly 49. Backfiller flap 15 extends from a rearward end of mesh guard 13. Backfiller outboard skids 11 extend from the lower surface of backfiller mesh guard 13 and can be adjusted to maximize the flow of soil into the trench.

In operation, shaft 17 rotates in the clockwise direction as shown in FIG. 5, causing auger cutting blades 21 to both cut up or refine large clumps of soil excavated by trenching assembly 49 and to propel the refined soil forwardly and inwardly to fill the trench. The soil is then compacted by the extended compacting ram 32. It should be noted that the terminal end of cylinder 31 is positioned near ribbon bar 19 such that extension of compacting ram 32 allows the refined soil to be compacted nearly simultaneously with the cutting action. The compacting ram may extend below and slightly behind the cutting blades into the trench during operation to compact the refilled soil. In FIG. 1, compacting ram assembly 7 is shown as being further away from backfiller assembly 9 than it would be in practice, in order to more clearly show the invention.

If desired and if there is a source of water available, water may be provided through water valve 95 located on top of shaft 29 to convert the excavated and refined soil into a slurry. Slurrying the soil improves the effect of compaction, eliminating air pockets and providing increased heat transfer along the pipes. The soil is slurried after refining.

Concrete vibrator flexible drive shaft 91 is located in the central chute of chute assembly 81. At one end, flexible drive shaft 91 is linked to concrete vibrator head 89, and at the other end flexible shaft 91 extends through chute assembly 81 and is linked to concrete vibrator engine 93 located on tractor 5. (Shaft 91 is shown as being severed although in practice it would be a unitary shaft.) The vibration frequency of concrete vibrator head 89 is adjustable and provides for better compaction of the slurry and elimination of air pockets.

In operation, trenching assembly 49 is initially activated to excavate the trench, gradually being lowered to a nearly vertical position. Multiple pipe chute assembly 81 is lowered after the trench is started and the trenching assembly is raised up to support the chute and is linked to trenching assembly 49 by chute hook 61 which is locked into position by locking pin 71. A vertical anchor pole is fixed in the excavated trench, and the ends of flexible pipes 84 are withdrawn from the end of pipe chute 81, and the pipes are clamped to the pole. The header ends of the flexible pipes are retained above the surface and are attached to a surface anchor. It should be noted that the flexible pipes are unwound from a plurality of reels located on a forward part of the tractor or on a separate attachment.

As forward progress of the tractor continues, the pipes are dispensed from chute assembly 81. Soil excavated from the trench is displaced laterally by trenching augers 47. Thereafter, rotation of backfiller shaft 17 causes blades 21 to refine the dirt and to propel it inwardly and forwardly back towards the trench due to the angled disposition of blades 21 across ribbon bar 19. If water is available, the soil is slurried. Compacting ram 32 compacts the refilled soil or slurry. Additionally, operation of concrete vibrator 89 increases the compacting effect of compacting ram 32. Skids 11 control the height of the backfill auger assembly above the ground level.

This invention has been described in detail in connection with preferred embodiments. These embodiments, however, are merely for example only, and the invention is not restricted thereto. It will be understood by those skilled in the art that other variations and modifications can easily be made within the scope of this invention as defined by the appended claims.

We claim:

1. A multiple pipe installation device comprising:

trenching means for excavating a trench, said trenching means pivotably mounted on the rear of a vehicle;

a multiple pipe chute means including a plurality of chutes, said multiple pipe chute means disposed rearwardly of and pivotably linked with respect to said trenching means, said multiple pipe chute means for containing a plurality of flexible pipes in a spaced relationship such that each said chute contains one pipe, and for dispensing and laying said pipes at a predetermined vertical distance apart in said trench;

backfiller means for refining and refilling soil excavated by said trenching means into said trench;

compacting means for compacting said soil refilled into said trench by said backfiller means;

support arm means for supporting said backfiller means at one end thereof and said compacting means at an intermediate position of said support arm means;

raising and lowering means linking both said support arm means and said chute means with said trenching means, said raising and lowering means for raising or lowering said support arm means with respect to said trenching means and said chute means.

2. The installation device recited in claim 1, said raising and lowering means includes a support frame and a hydraulic cylinder, said support frame fixedly attached to said trenching means, said hydraulic cylinder attached at one end to said support frame, said hydraulic cylinder linked at an opposite end to said support arm means, extension and contraction of said hydraulic cylinder raising and lowering said support arm means with respect to said chute means and said trenching means.

3. The installation device recited in claim 2, said raising and lowering means further includes a pivotable support means attached to said support frame for allowing pivoting motion of said support arm means in a vertical plane so that said support arm means may be raised or lowered, said support arm means linked at the end opposite said backfiller means to said support means, said support arm means also pivotable in a plane perpendicular to said vertical plane about a pivot rod extending longitudinally through said support means.

4. The installation device recited in claim 3, said support frame comprising at least one H-shaped frame fixedly connected to said trenching means at one end, said support means pivotable about a pivot point located on said H-shaped frame.

5. The installation device recited in claim 2, said support arm means includes a first extension having a first pinhole therein, said pipe chute means including a second extension having a second pinhole therein, said support arm means movable to a position where said first and said second pinholes are adjacent each other, said pinholes linkable by a locking pin linking said chute means with said support arm means such that extension or contraction of said hydraulic cylinder jointly raises or lowers both said support arm means and said pipe chute means with respect to said trenching means.

6. The installation device recited in claim 5, said chute means including a locking shaft extending from one surface, said support frame including a locking hook at one end, said locking hook positionable about said locking shaft to link said chute means to said trenching means via said support frame when said chute means is not linked to said support arm means, wherein extension or contraction of said hydraulic cylinder raises and lowers said support arm means with respect to said trenching means.

7. The installation device recited in claim 6 further including a locking hook actuating lever disposed on said support frame, said locking pin disposable through one end of said hook actuating lever and simultaneously through said support frame for locking said locking hook in position about said locking shaft.

8. The installation device recited in claim 1, said raising and lowering means further including switchable link means for selectively linking either said chute means to said support arm means or said chute means to said trenching means, wherein both said chute means and said support arm means may be raised with respect to said trenching means, or said support arm means may be raised with respect to both said chute means and said trenching means, respectively.

9. The installation device recited in claim 1, said backfiller means comprising a drive shaft, a helical cutting bar disposed around and welded to said drive shaft, and cutting blades disposed across the outer surface of said cutting bar.

10. The installation device recited in claim 9, said cutting blades disposed at approximately a 45° angle across said cutting bar.

11. The installation device recited in claim 9, said drive shaft driven by a chain drive extending downwardly from said support arm means.

12. The installation device recited in claim 9, said backfiller means further including a meshed housing extending around said drive shaft, said cutting bar and said cutting blades, a hinged flap extending from an outer surface of said meshed housing, and at least one skid extending below said meshed housing.

13. The installation device recited in claim 1, said compacting means including an extendible compacting ram disposed below said support arm means, the end of said ram extending below and behind said backfiller means when said ram is in a maximal extended position.

14. The installation device recited in claim 13, the angle of said compacting ram with said support arm means being adjustable.

15. The installation device recited in claim 13, said compacting means further including a mounting bracket disposed on said support arm means, said mounting bracket having a plurality of openings adjacent opposite ends thereof, a support rod pivotably mounted at one end through a selected one of said plurality of holes at one end of said mounting bracket, the other end of said support rod attached to said compacting ram, said compacting means further including an angle adjusting arm fixedly attached at one end to a selected one of said plurality of holes at an opposite end of said mounting bracket, the opposite end of said angle adjusting arm attached to said compacting ram, wherein, the angle of said compacting ram may be selectively adjusted by changing either the hole through which said support rod is pivotable, the hole through which said angle adjusting arm is linked, or both.

16. The installation device recited in claim 1 further comprising a water valve disposed on said support arm means adjacent said backfiller means, said water valve spraying water on said excavated soil to slurry said soil before compaction thereof by said compacting means.

17. The installation device recited in claim 1 further comprising a vibrator engine, a flexible shaft attached at one end to a vibrator engine, said flexible shaft extending through and beyond one of said plurality of chutes, and a concrete vibrator head attached to the opposite end of said flexible shaft, said concrete vibrator head trailing behind said chute means during forward motion thereof, said concrete vibrator head vibrated by said engine to facilitate compaction of said refilled soil by said compacting means.

18. The installation device recited in claim 1, said multiple pipe chute means further including a pipe retainer bar extending across a lower end thereof near the terminal ends of said plurality of chutes, said retainer bar retaining said flexible pipe in said chutes.

19. The installation device recited in claim 18, said pipe retainer bar hinged for removal at an upper end thereof.

20. The installation device recited in claim 1, said multiple pipe chute means further including a tension brake extending across an upper end thereof, said tension brake including a plurality of adjustable screws corresponding to said plurality of chutes, said screws independently adjusting the tension on each said flexible pipe.

21. The installation device recited in claim 1 further comprising belting means extending across a rearward portion of said chute means, said belting means including slots therein corresponding to said plurality of chutes to allow said flexible pipes to extend therethrough, said belting means extending below said chute means for preventing refilled soil from entering a region between said chutes means and said trenching means.

22. The installation device recited in claim 1, said trenching means including a trenching belt having trenching teeth extending from an exterior surface thereof for carrying soil upwardly towards the surface, and trenching auger means disposed laterally on both sides of said trenching chain for moving excavated soil laterally away from said trenching chain.

23. A method for laying a plurality of flexible utility pipes comprising the steps of:

excavating soil upwardly towards the surface to forwardly and progressively excavate a trench in the earth;

removing excavated soil on the surface laterally during progressive excavation;

laying a plurality of flexible utility pipes a predetermined vertical distance apart, said pipes continually laid rearwardly of a forward wall of said trench during progressive forward excavation;

refining said excavated soil and propelling said excavated soil forwardly and inwardly to cover said laid pipes and to refill said trench;

compacting said refilled soil; and vibrating said refilled soil from below before and during said compaction of said soil wherein each of said steps occurs sequentially and continually.

24. The method recited in claim 23 including the additional step of slurrying said excavated soil before and after refining and propulsion of said soil.

* * * * *